US009441900B1

(12) United States Patent
Parrish

(10) Patent No.: US 9,441,900 B1
(45) Date of Patent: Sep. 13, 2016

(54) CONCENTRIC SPIRALED CHAMBER FIREARM SUPPRESSOR

(71) Applicant: Carlton Parrish, Walters, OK (US)

(72) Inventor: Carlton Parrish, Walters, OK (US)

( * ) Notice: Subject to any disclaimer, the term of this patent is extended or adjusted under 35 U.S.C. 154(b) by 0 days.

(21) Appl. No.: 14/718,874

(22) Filed: May 21, 2015

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.2, 14.4
See application file for complete search history.

(56) References Cited

U.S. PATENT DOCUMENTS 794,926 A * 7/1905 Crawford ..... F01N 1/12 181/279
916,885 A * 3/1909 Maxim ..... F41A 21/30 181/223
1,289,750 A * 12/1918 Hauman ..... F01N 1/18 181/277
1,770,471 A * 7/1930 Hatcher ..... F41A 21/30 181/223
3,062,317 A * 11/1962 Pigman ..... F01N 1/12 181/279
3,066,755 A * 12/1962 Diehl ..... F01N 1/12 181/279
3,759,134 A * 9/1973 Cox ..... F41A 21/30 89/14.4
5,824,972 A * 10/1998 Butler ..... F01N 1/087 181/265
8,973,481 B2 3/2015 Dueck et al.
8,978,818 B2 3/2015 Proske

FOREIGN PATENT DOCUMENTS

GB 439006 A * 11/1935 ..... F41A 21/30

OTHER PUBLICATIONS

Allen, Ashley Allen; "Mathematical Modeling of the Nautilus Shell", retrieved on May 11, 2015 from www.bsu.edu/libraries/beneficencepress/mathexchange/01-01/allen.pdf.
Leghorn, Nick; "Jesse James Releases New 30 Caliber Silencer, With some Bold Claims", retrieved on May 11, 2015 from http://www.thetruthaboutguns.com/2015/01/foghorn/.
Cohen, Don; "Comparing patterns in Equiangular Spirals for #1 The Nautilus shell, #2 The Fibonacci Numbers (the Golden Mean), & #3. Equal Tempered Chromatic Music Scale", retrieved on May 11, 2015 from http://www.mathman.biz/html/colorspirals.html.

* cited by examiner

*Primary Examiner* — Reginald Tillman, Jr.
(74) *Attorney, Agent, or Firm* — Robert Frantz

(57) ABSTRACT

A suppressor of an audible sound, especially useful for an impulse sound such as the report of a firearm, has a bore formed through a body for co-axial alignment with an exhaust of the device which produces the sound, one or more chambers within the suppressor body, each chamber having a spiral volume, and receivers for sound producing matter into the outer ends of each chamber so as to allow the sound producing matter to be expanded into the spiral volumes to reduce audible sounds presented at an output of the bore.

20 Claims, 8 Drawing Sheets

CONCENTRIC SPIRALED CHAMBER FIREARM SUPPRESSOR

FIELD OF THE INVENTION

The invention generally relates to devices for reducing impulse noises such as reports from firearms.

BACKGROUND OF INVENTION

The "report" or "gunshot sound" heard when a firearm is discharged generally derives from two sources. The first source is the actual sound of the propellant gasses exploding, which emerge from the muzzle end of a barrel. The second source is the sound of the actual projectile or bullet breaking the sound barrier, if the "load" is a hypersonic load. Some bullets and some loads are subsonic, so in their cases, the report is primarily from the explosion of the propellant gasses.

Available firearm sound suppressors, also informally referred to as "silencers", are of a generally cylindrical configuration, attaching to the end of the barrel of a firearm using threading or some other means of retention. A bore is formed through a number of internal baffles such that the bullet and expanding gasses emerge from the muzzle end of the barrel and then travel through the bore of the suppressor. The baffles within the bore are generally disc-shaped and oriented orthogonally to the linear path of the bullet (e.g., orthogonal to the axis of the barrel). Spaces between the baffles and bounded by the outer cylinder of the suppressor form one or more chambers. As the gasses enter the chamber (s), they are subject to various interactions with the baffles in order to absorb energy from the gasses, thereby reducing the sound caused by the gasses and/or the bullet breaking the sound barrier. The general configuration of these suppressors are, therefore, cylindrical attachments which extend the length of the barrel.

SUMMARY OF THE INVENTION

One or more embodiments of an invention are disclosed for a suppressor of an audible sound, especially useful for an impulse sound such as the report of a firearm, having a bore formed through a suppressor body for co-axial alignment with an exhaust of a device which produces the sound, one or more chambers within the suppressor body having a spiral volume, and receivers for sound producing matter into the outer ends of each spiral volume so as to allow the sound producing matter to be received and expanded into the spiral volumes to reduce audible sounds presented at the output of the bore.

BRIEF DESCRIPTION OF THE DRAWINGS

The description set forth herein is illustrated by the several drawings.

DETAILED DESCRIPTION OF EMBODIMENT(S) OF THE INVENTION

Figure 1A:
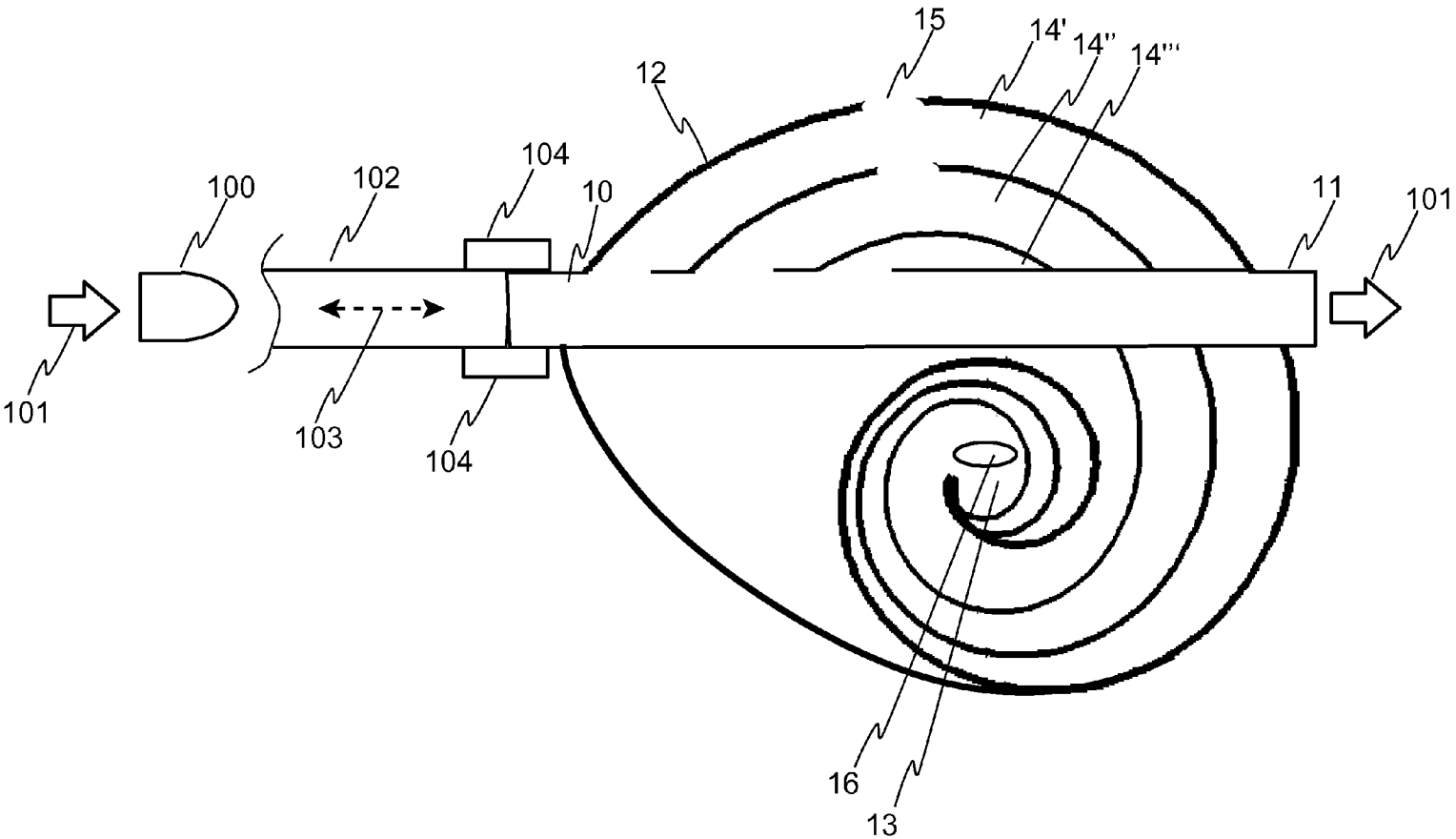
FIGS. 1*a*-1*f* set forth a cut-away views of internal concentric spiral-shaped chambers, including optional flute ports and optional baffles.

The present inventor has recognized a number of problems in the suppressors of the known types previously described. The amount of suppression, usually measured in decibels (dB) of sound reduction, provided by a suppressor is generally increased with increases in the length of the suppressor and with increases in the number of baffles and chambers defined therein.

However, a long suppressor can be problematic for a firearm such as a tactical rifle or pistol which is intended for use in tight quarters, such as within buildings and in heavily forested environs. Long barrels can be clumsy to maneuver around corners, trees, through windows, and within vehicles. The addition of significant length can cause a firearm which is useful for these applications to become undesirable for such conditions.

Further, as the typical suppressor's number of baffles and chambers is increased, so is the weight of the suppressor. This is undesirable for at least two reasons. First, for floating barrel design rifles, the added weight at the end of the barrel actually changes the aim of the barrel, such that any sighting device (e.g., scope, red-dot reticle, etc.) which was "zeroed" (e.g., calibrated) before the attachment of the suppressor is now inaccurate. Thus, in some tactical environments and mission profiles, it is desired to attach and detach suppressors during different phases of the operation, and re-zeroing the sighting device is impractical. Second, the added weight to the end of the barrel produces leverage in a downward angle at the radius as measured from the forearm (of a rifle) or from the top of the trigger finger (of a pistol) to the muzzle. This can produce a fair amount of rotational force about the forearm or trigger finger, tending to tip the firearm towards a downward impact point, thereby causing the operator to have to compensate for this force, leading to fatigue and inaccuracy.

Having recognized these problems in the well-known suppressor types, the present inventor has designed and hereby discloses two general configurations according to his invention: (a) a spiraling-chambered suppressor especially useful for use with a pistol but also useful for rifles and long guns, and (b) an oblong high pressure suppressor especially useful with rifles and long guns but also useful for pistols in some embodiments. The embodiments may also serve as a flash suppressor to reduce the appearance of light from the captured expanding gasses.

In some embodiments, the new suppressor design avoids threaded attachment, making it easier and quicker to attach and detach, which improves its utility in tactical missions. A more fluid operation procedure reduces the time of alteration (e.g., the time attaching or detaching) during which the user is incapable of firing the firearm and is in a transitional status.

Some embodiments of the invention disclosed herein achieve a greater volume of enclosed (chambered) space in which the propellant gasses and pressures may dissipate, thereby reducing the pressure indifference that is a result of the firearm's projectile's propellant pressure which is greater than the ambient environmental atmospheric pressure. By reducing this pressure difference, the suppressor reduces and transmutes the resulting report to a lower decibel and/or to a frequency not within the spectrum of perceivable frequencies by the human ear, similar to the frequency and energy transmutation of a dog whistle. Some embodiments may also reduce the recoil forces transmitted by the firearm to the hand or shoulder of the user.

FIG. 1*a* illustrates a side cut-away view of one particular embodiment which has a plurality of nested or concentric Nautilus-like shapes. Such a shape may be any spiral, such as but not limited to a Fibonacci or golden ratio spiral and an equal tempered chromatic spiral. Such spiral curves and shapes can be generally described using Eq. 1:

$$r=a\cdot e^{\theta\cot(b)} \quad \text{Eq. 1}$$

In Eq. 1, the equiangular or logarithmic curves are described by a tightness constant a, and an angle b between the radial line and the tangent line. With such an generalized equation, many different curves, nesting within each other, may be generated using different values of a, b and θ.

In this illustration, three concentric (13) spiral expansion chambers (14', 14", and 14'") are formed between concentric spiral walls, each chamber having a port to the bore for travel of the bullet (100) from the muzzle of a barrel (102). The bullet (100) travels (101) from the firing chamber of the firearm (not shown) into an inlet port (10) of the suppressor, through the bore, and exits from the outlet port (11). The bore of the suppressor is coaxially aligned with the axis (103) of the firearm's barrel, and attached to the muzzle using an attachment means (104) such as a connector, threading, etc.

Figure 1B:
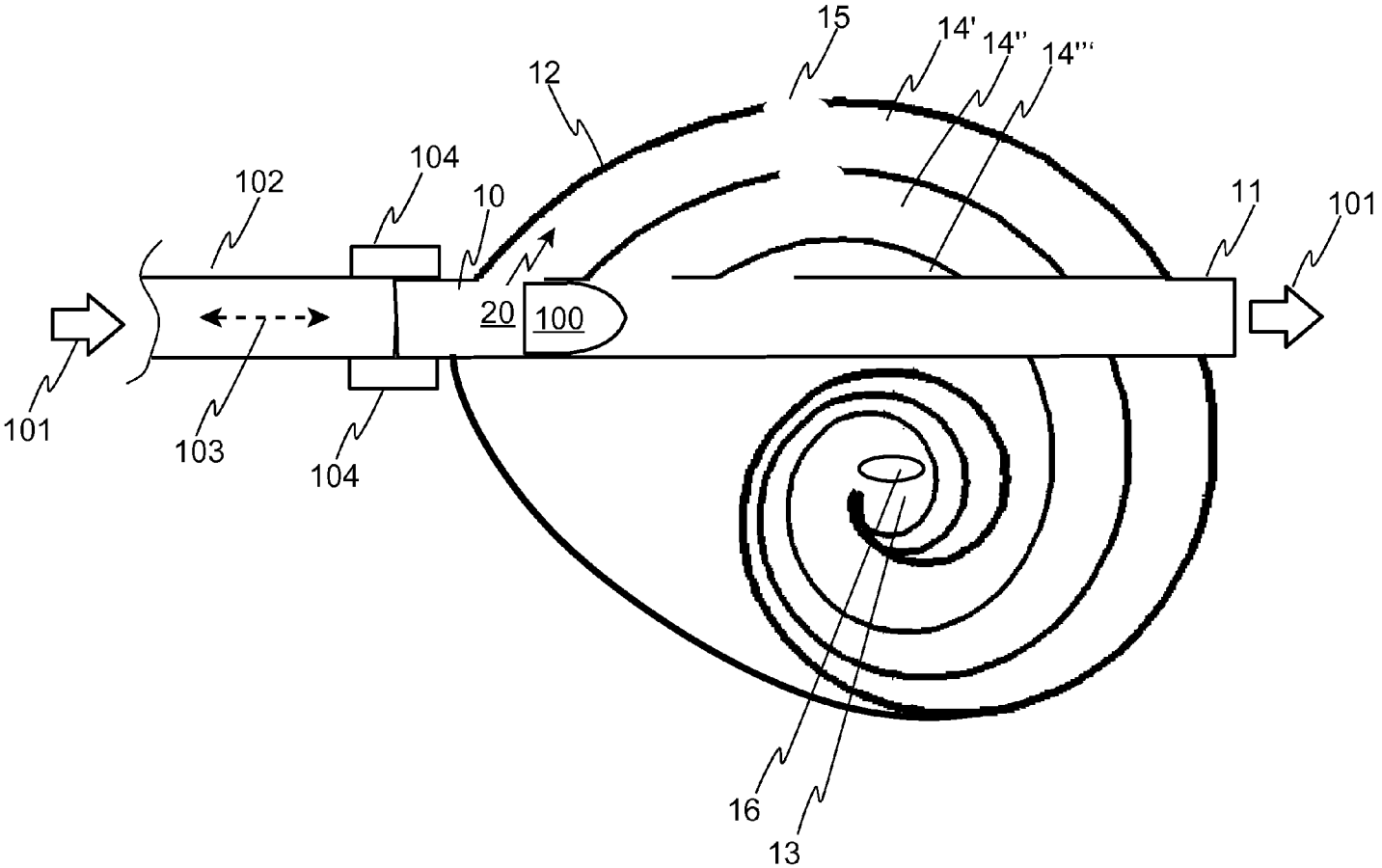
Figure 1C:
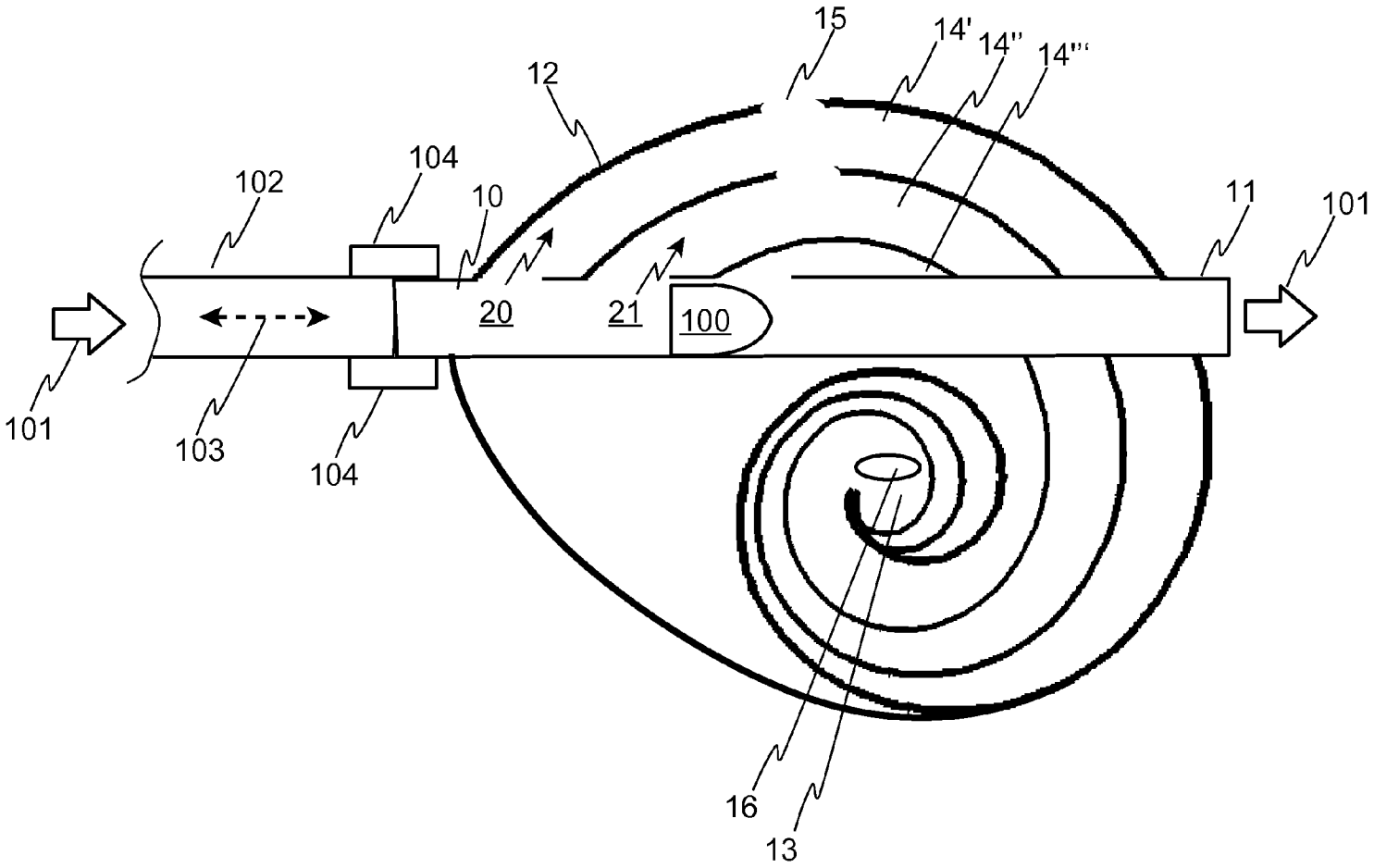

As the bullet (100) travels past the first port to the first chamber (14'), as shown in FIG. 1*b*, a first portion (20) of expanding gas is received into the first chamber, where it is allowed to expand along the route of the chamber in a spiraling path, thereby expanding the volume of the portion of gas (20), which reduces the pressure of the portion (20) of gas. The spiral path within the chamber tends to impede the expansion to some degree, thereby absorbing some of the energy contained in the portion (20).

As the bullet (100) continues to travel past the second port to the second chamber (14"), a second portion (21) of expanding gas is received into the second chamber, where it is allowed to expand along the route of the second chamber in a similarly spiraling path, thereby expanding the volume of the second portion of gas (21), reducing the pressure of that portion and absorbing some of the energy contained in the portion (21).

Figure 1D:
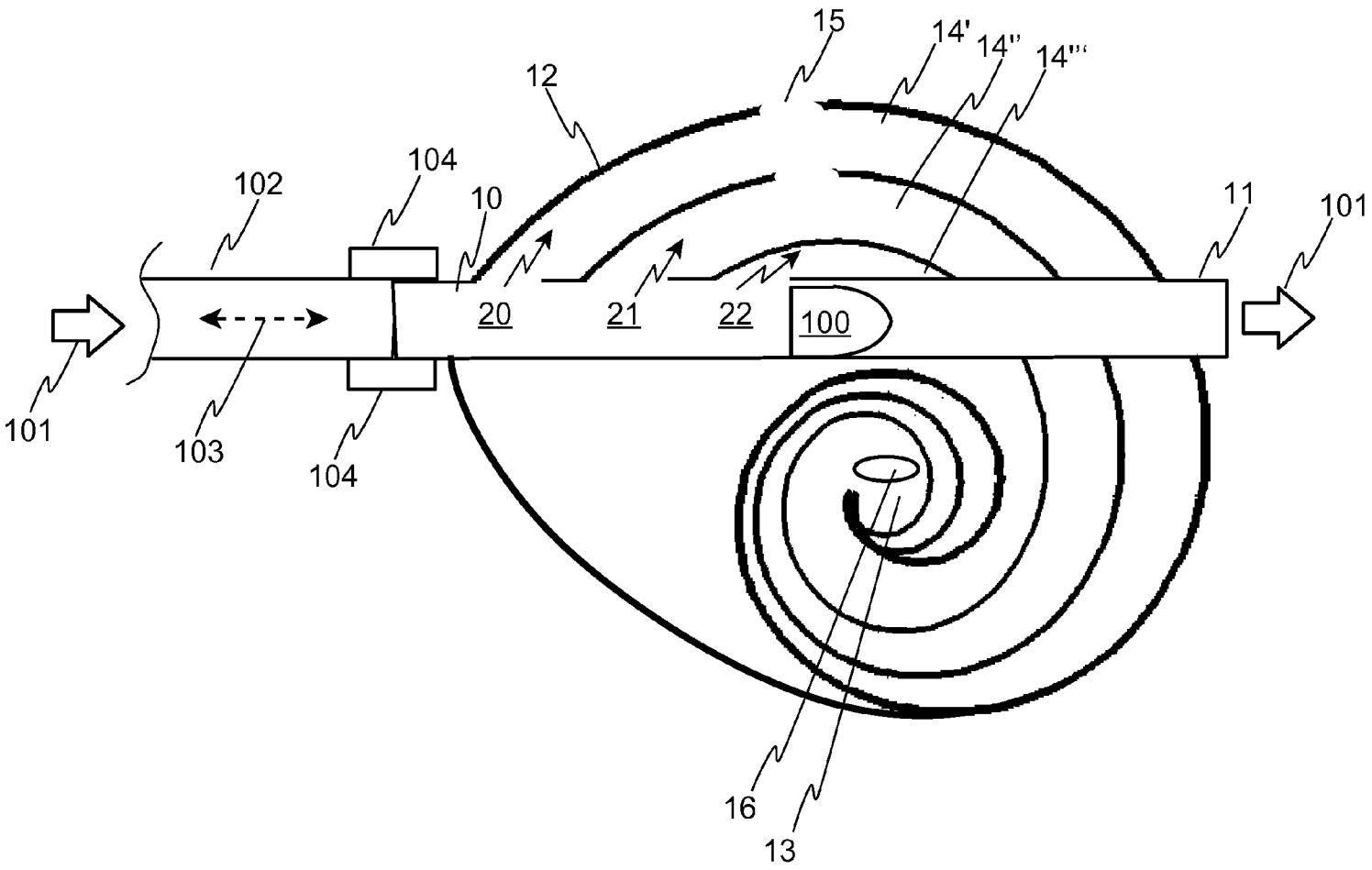

Further, as shown in FIG. 1*d*, the bullet (100) continues to travel past the third port to the third chamber (14'") such that a third portion (22) of expanding gas is received into the third chamber, where it too is allowed to expand along the spiraling route of the third chamber to reduce the pressure and energy of that portion (22).

The example shown in FIGS. 1*a*-1*d* employ three concentric spiraling chambers, but other embodiments may employ more or less chambers, and may employ variations of spirals having more or less tightness and greater or lesser angles, as described by Eq. 1.

In some embodiments, additional suppression of sound and/or flash can be obtained by providing flute ports (15) in one or more of the chambers, and optionally at the center of the chambers (16). These ports are designed to resonate at a frequency outside usual human hearing range, so that as gas expands past each of them, they transmute some of the energy of the gas into an acoustic wave of such a non-audible frequency.

Figure 1E:
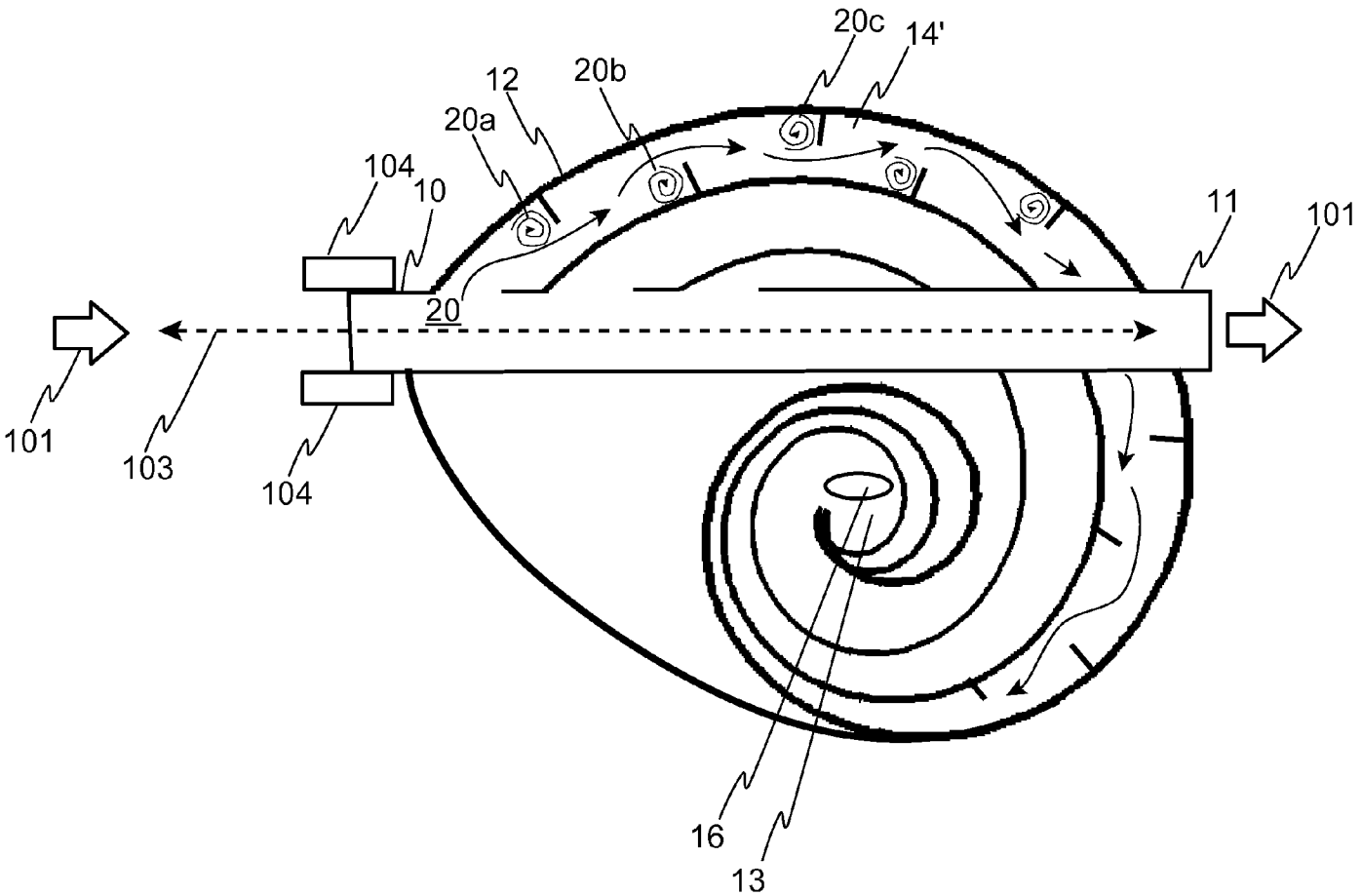

In other embodiments, such as the one shown in FIG. 1*e*, a series of baffles (shown as wall sections orthogonal to the spiral dividers) may be disposed in the chamber, such as in the first chamber (14') to partially impeded the pathway (20) of the expanding gasses. The baffles may be disposed in an alternating pattern, such as shown, in one or more of the chambers according to the desired performance of the suppressor. Such baffles are designed to cause areas or volumes of turbulence (20*a*, 20*b*, 20*c*, etc.) similar to eddy currents in flows of other materials.

Also, please note in this drawing the continuous pathway extends initially above the bore, then descends and passes behind the bore of the suppressor, communicating from the upper sections of the chambers to the lower sections of the chambers is illustrated as well. While the spiraling chambers may be oriented above the bore in some embodiments, the lower-hanging configuration (as shown) is useful for firearms which have sighting systems oriented above and along to top of the barrel. Further, similar structures may be disposed on opposite sides of the bore for more acoustic dampening performance.

Figure 1F:
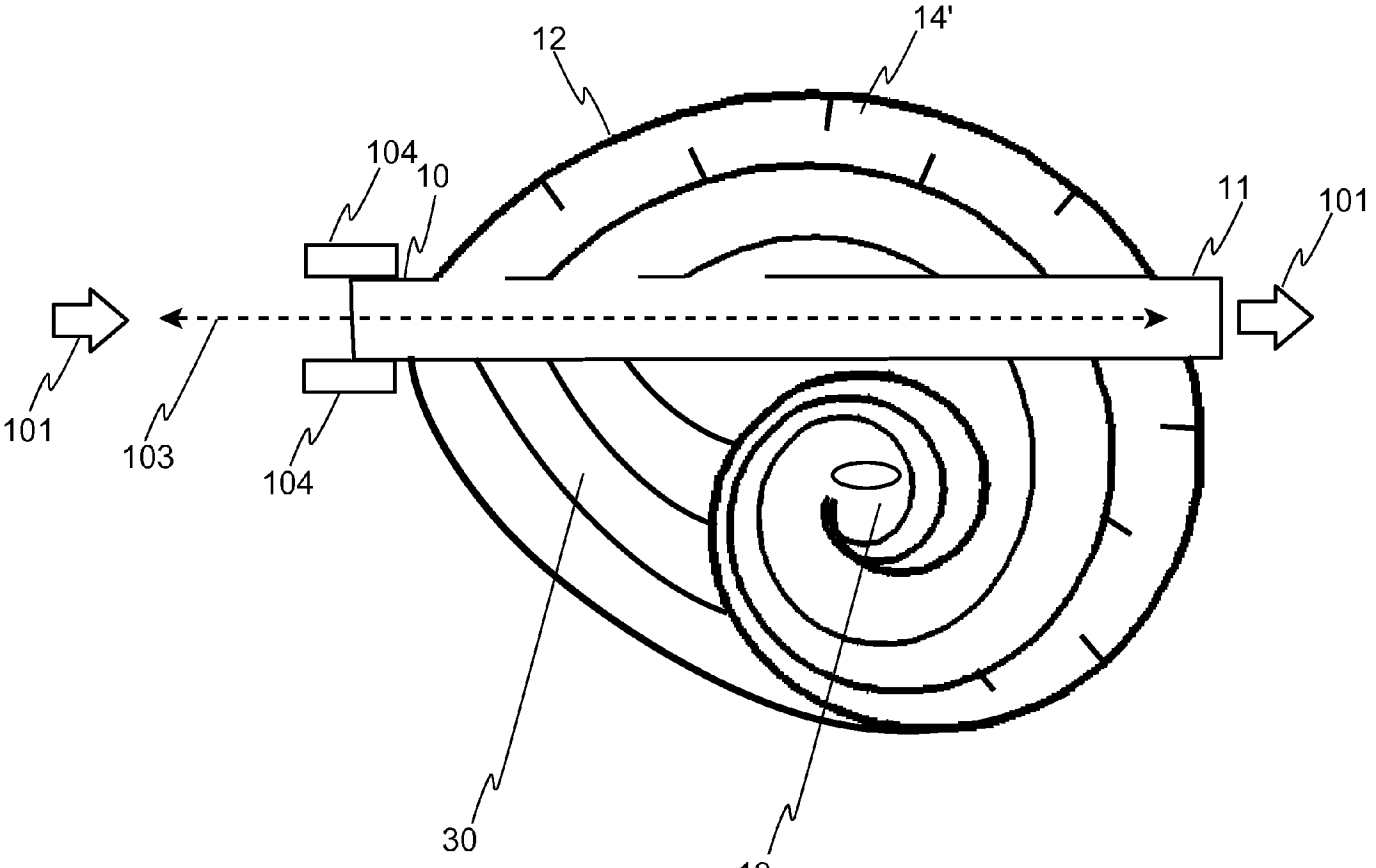

Referring to FIG. 1*f*, additional optional baffles (30) are shown in the cavity formed in the body of the suppressor which do not necessarily communicate into the volume of the expansion chambers, and which can sympathetically resonate through mechanical coupling to the chambers in order to absorb additional acoustic energy.

Figure 2:
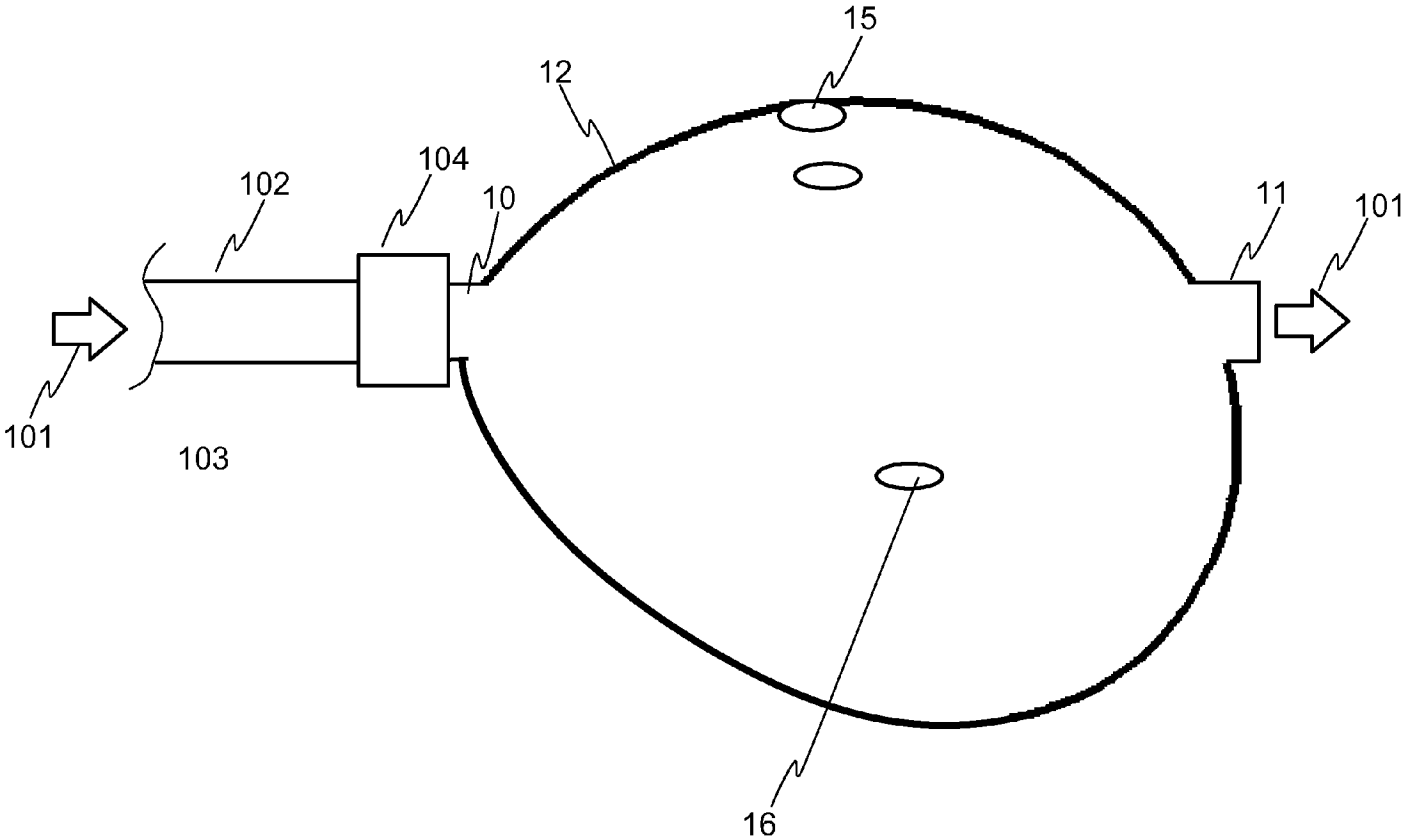
FIG. 2 provides an external view illustration of an embodiment according to the present invention as attached to a muzzle end of a firearm barrel.
Figure 3:
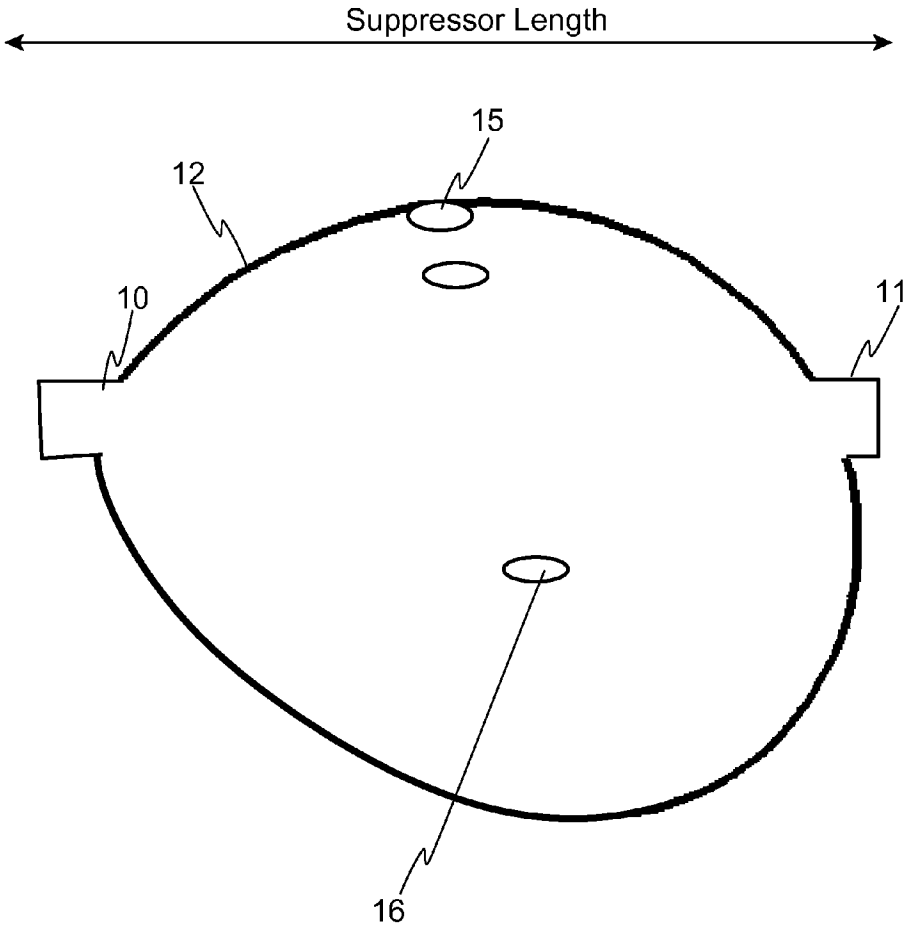
FIG. 3 shows a similar view to that of FIG. 2, separated and detached from a firearm barrel.

FIG. 2 shows an external side view of the suppressor (12) which is attached (104) to a muzzle end of a firearm barrel (102) via its input port (10), and presenting its output port (11) with the optional flute ports (15, 16). FIG. 3 shows the same side view with the suppressor detached from the firearm.

From these views and exemplary embodiments, one can observe that the total expansion volume, baffling action caused by the spiraling paths, and lengths of the concentric spiral paths provide a substantial amount of suppression action with significantly reduced suppressor length than comparably-performing cylindrical suppressors. This allows for less interference of the use of the firearm in a close quarters mission profile, and places less leverage on the barrel, thereby changing the aiming point less than longer-length suppressors.

Embodiments of the suppressor may be comprised of metal, alloys, composites, plastics and/or ceramics, alone or in combination, to suit the desired performance characteristics of the suppressor. To yield a suppressor, methods of forming devices such as molding, machining, and three-dimensional printing may be used, alone or in combination, to produce a device having one or more components which, when assembled, realize a device such as those embodiments described herein or such as other embodiments within the spirit and scope of the invention.

CONCLUSION

It should be recognized by those skilled in the art that the present disclosure of one or more embodiments according to the invention is intended for illustrative purposes, and not for the purpose of defining the limits of the present invention. It is within the skill in the art, given the present disclosure, to design additional embodiments, variations, combinations, and sub-combinations which fall within the spirit and scope of the present invention as set forth in the following claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The one or more embodiments were chosen and described in order to best explain the principles of the invention and the practical application, and to enable others of ordinary skill in the art to understand the invention for various embodiments with various modifications as are suited to the particular use contemplated.

What is claimed is:

1. A suppressor for an audible impulse sound comprising:

a bore extending from an inlet port through a suppressor body to an outlet port for co-axial alignment with a firearm barrel muzzle which produces impulse sound and emits a projectile, wherein the bore allows unimpeded linear passage of the projectile: at least a first chamber within the suppressor body having a first spiral volume; and a first receiver for a first portion of sound-producing matter oriented towards an outermost end of the first chamber communicatively interfaced to the bore near the inlet port such that a portion of the bore between the outlet port and the first receiver forms a barrel portion:

wherein the first portion of sound producing matter is received at the first receiver and allowed to expand into the first spiral volume, wherein the first spiral volume proceeds in a decreasing radius about a center conforming to a logarithmic spiral equation, thereby reducing audible sound from said first portion as the first portion of sound producing matter travels in the spiral volume with the decreasing radius.

2. The suppressor as set forth in claim 1 wherein the firearm comprises at least one firearm selected from the group consisting of a rifle, a shotgun, a long gun, a pistol, a handgun, a revolver, a cannon, an artillery piece, a mortar, a nail gun, a stapler, a paintball gun, a rail gun, and a device for sending a projectile down a barrel.

3. The suppressor as set forth in claim 1 wherein the sound producing matter comprises expanding gas from a propellant.

4. The suppressor as set forth in claim 3 wherein the propellant comprises gun powder.

5. The suppressor as set forth in claim 1 further comprising:

one or more additional chambers, each additional chamber providing a spiral volume concentric with the first chamber; and each additional chamber having an additional receiver for receiving additional portions of sound producing matter from the bore.

6. The suppressor as set forth in claim 1 wherein one or more baffles are disposed in the first chamber.

7. The suppressor as set forth in claim 1 wherein one or more flute ports are provided communicative between the first chamber and an ambient exterior of the body, wherein the expanding sound producing material expends energy upon one or more flute edges of the flute ports to transmute the energy to a non-audible wave in an ambient matter.

8. The suppressor as set forth in claim 7 wherein the ambient matter comprises air.

9. The suppressor as set forth in claim 7 wherein the ambient matter comprises water.

10. The suppressor as set forth in claim 1 further comprising one or more passive resonance chambers mechanically sympathetic to the first chamber.

11. A method of producing a suppressor for an audible impulse sound comprising the steps of: forming a bore extending from an inlet port through a suppressor body to an outlet port for co-axial alignment with a firearm barrel muzzle which produces impulse sound and emits a projectile, wherein the bore allows unimpeded linear passage of the projectile: providing at least a first chamber within the suppressor body having a first spiral volume; and providing a first receiver for a first portion of sound-producing matter communicative between an outermost end of the first chamber communicatively interfaced and to bore near the inlet port such that a portion of the bore between the outlet port and the first receiver forms a barrel portion: wherein the first portion of sound producing matter is received at the first receiver and allowed to expand into the first spiral volume, wherein the first spiral volume proceeds in a decreasing radius about a center conforming to a logarithmic spiral equation, thereby reducing audible sound from said first portion as the first portion of sound producing matter travels in the spiral volume with the decreasing radius.

12. The method as set forth in claim 11 wherein the firearm comprises a firearm selected from the group consisting of a rifle, a shotgun, a long gun, a pistol, a handgun, a revolver, a cannon, an artillery piece, a mortar, a nail gun, a stapler, a paintball gun, a rail gun, and a device for sending a projectile down a barrel.

13. The method as set forth in claim 11 wherein the sound producing matter comprises expanding gas from a propellant.

14. The method as set forth in claim 13 wherein the propellant comprises gun powder.

15. The method as set forth in claim 11 further comprising:

providing one or more additional chambers, each additional chamber providing a spiral volume concentric with the first chamber; and providing each additional chamber with an additional receiver for receiving additional portions of sound producing matter from the bore.

16. The method as set forth in claim 11 further comprising disposing one or more baffles in the first chamber.

17. The method as set forth in claim 11 further comprising providing one or more flute ports communicative between the first chamber and an ambient exterior of the body, wherein the expanding sound producing material is allowed to expend energy upon one or more flute edges of the flute ports to transmute the energy to a non-audible wave in an ambient matter.

18. The method as set forth in claim 17 wherein the ambient matter comprises air.

19. The method as set forth in claim 17 wherein the ambient matter comprises water.

20. The method as set forth in claim 11 further comprising providing one or more passive resonance chambers mechanically sympathetic to the first chamber.

* * * * *